US005598628A

United States Patent [19]

Maejima

[11] Patent Number: 5,598,628

[45] Date of Patent: Feb. 4, 1997

[54] TERMINAL INSERTION DEVICE AND AN INSERTING METHOD THEREOF

[75] Inventor: Takamichi Maejima, Shizuoka, Japan

[73] Assignee: Yazaki Corporation, Tokyo, Japan

[21] Appl. No.: 537,121

[22] Filed: Sep. 29, 1995

[30] Foreign Application Priority Data

Oct. 7, 1994 [JP] Japan ..... 6-243754

[51] Int. Cl.[6] ..... H01R 43/00

[52] U.S. Cl. ..... 29/868; 29/754; 29/759; 29/760

[58] Field of Search ..... 29/845, 868, 872, 29/748, 759, 754, 760

[56] References Cited

U.S. PATENT DOCUMENTS

| | | | |
|---|---|---|---|
| 4,825,537 | 5/1989 | Berry et al. | 29/747 |
| 4,967,470 | 11/1990 | Folk | 29/748 |
| 5,414,925 | 5/1995 | Nishide et al. | 29/748 |

*Primary Examiner*—P. W. Echols
*Assistant Examiner*—Adrian L. Coley
*Attorney, Agent, or Firm*—Armstrong, Westerman, Hattori, McLeland & Naughton

[57] ABSTRACT

The present invention provides a terminal insertion device in which a wired terminal can be securely taken out without abutting against the guide arms in case the insertion is imperfectly done, and also the guide arms can be shifted upwardly without being entangled with other leading wires 6*b* after the perfect insertion is detected. The terminal insertion device comprises a monolithic plate 5 on which holding hands 3 and 4 for clamping a wired terminal 6 and a pair of lead wire guide arms 2, 2 for guiding the wired terminal into a connector housing, and the monolithic plate 5 can be moved in the horizontal and vertical directions respectively by a driving means 24 and 26, wherein a front wall 7 of the plate 5 is formed with a first open-close cylinder 10, whereas first and second open-close cylinders 13 and 14 are formed on a junction plate 9 which is engaged with a side wall 8 of the plate 5 in the forwardly and rearwardly movable manner, and a horizontal cylinder 24 disposed on a frame board is further connected wit the side wall. With the construction above, the holding arms and the pair of guide arms are urged integrally backward on checking the inserted state of the terminal, and they are shifted backwardly to be located behind leading wires of other wired terminals extended from the connector housing, and sent upward thereafter.

5 Claims, 10 Drawing Sheets

TERMINAL INSERTION DEVICE AND AN INSERTING METHOD THEREOF

BACKGROUND OF THE INVENTION

1 Field of the Invention

The present invention relates to a wired terminal insertion device for inserting a wired terminal clamped by holding hands into a connector housing through a space between guide arms and also relates to a method for the insertion thereof, wherein the holding hands and the guide arms are integrally shifted so as to prevent the terminal from being interfered with the guide arms when they are pulled backward on checking the inserted state of the terminal after the insertion thereof, and also to prevent the guide arms from damaging the leading wires extended from the connector housing when the guide arms are sent upward.

2 Description of the Prior Art

FIGS. 12 and 13 indicate a conventional terminal insertion method, wherein a pair of guide arms 2 are lowered to be inserted among a plurality of lead wires 6*b* extended from a connecting housing 32, and thereafter the guide arms 2 are opened to such an extent as slightly wider than the width L of a terminal 6*a* of a wired terminal 6 just in front of a selected terminal accommodating chamber 32*a* so as to lead the wired terminal 6 therebetween and insert it into the terminal accommodating chamber 32*a*.

The wired terminal 6 is clamped by a terminal holding hand 3 for holding a part of the wire portion directly behind the terminal portion thereof and a wire holding hand 4 for holding a further rear part of the wire portion, and after the front end portion of the terminal 6*a* is inserted into the terminal accommodating chamber 32*a* by the terminal holding hand 3 (a preliminary insertion), the terminal holding hand 3 is opened to release the terminal 6*a* and the wired terminal 6 is then completely inserted by the wire holding hand 4 (secondary insertion).

Then, after inserting the wired terminal 6 entirely, the wire holding hand 4 clamping the wire 6*b* of the wired terminal 6 is pulled rearwardly by a horizontal cylinder (not shown) to check whether or not the terminal 6*a* is securely inserted and locked by a locking lance (not shown) of the connector housing 32, and as the result if it is detected that the insertion has been done correctly, the both holding hands 3, 4, and the guide arm 2 are respectively sent upward to prepare the next terminal insertion.

In the method mentioned above, however,in case the terminal 6*a* comes off from the connector housing 32*a* due to an incomplete insertion of the terminal detected during the insertion checking operation, the rear portion of the terminal 6*a* is likely to abut against the front portion of the guide arms 2 to cause an erroneous function. Further, when sending the guide arms 2 upward after the complete insertion is checked, a guide projection 2*b* formed in one of the guide arms 2 is likely to be entangled with the leading wires 6*b* located thereabove to give a damage thereto.

SUMMARY OF THE INVENTION

The present invention has been made to solve the above-mentioned problems, and accordingly, it is an object of the present invention to provide a terminal insertion device in which a terminal 6*a* of a wired terminal 6 can be securely taken out without abutting against the guide arms 2 in case the insertion is imperfectly done, and also the guide arms 2 can be shifted upwardly without being entangled with other leading wires 6*b* after the perfect insertion is detected.

In order to accomplish the above objective, the present invention provides a terminal insertion device comprising wired terminal holding hands and a pair of guide arms for inserting a wired terminal clamped by the holding hands into a connector housing through a space between the pair of guide arms, wherein the holding hands and the guide arms are integrally disposed on a monolithic plate which can be shifted in the backward and forward directions as well as in the upward and downward directions by a driving means.

In the terminal insertion device above, it can be further arranged such that the monolithic plate is composed of a front wall and a side wall forming substantially a T shape, wherein the front wall is further provided with an open-close cylinder for activating the guide arms to be opened or closed, whereas the side wall is provided with a junction plate engaged therewith in a vertically slidable manner, which junction plate being formed with open-close cylinders for activating the respective holding hands thereon, and also being connected with a vertical cylinder mounted on the side wall, wherein the side wall is further engaged with a frame board which is formed outside the side wall in the forwardly and rearwardly movable manner, and is also connected with a horizontal cylinder mounted to the frame board. The terminal insertion device can be further arranged such that the open-close cylinders for activating the respective holding hands are engageably formed with the 3unction plate in the forwardly and rearwardly movable manner, and these open-close cylinders for the holding hands are further connected with a pair of horizontal cylinders mounted also on the junction plate.

Further, a method for a terminal insertion according to the present invention comprises the steps of; clamping a wired terminal with holding hands, inserting a pair of guide arms among a plurality of leading wires extended from the connector housing, opening the pair of guide arms, inserting the wired terminal into the connector housing through a space between the opened guide arms, checking the inserted state of the wired terminal by pulling the wire portion of the wired terminal backward with the holding hands, characterized in that for checking the inserted state, the holding hands are urged backward integrally with the guide arms and shifted to a position behind the leading wires, and thereafter they are further shifted integrally to the upward direction to be put aside.

The movement of the device as a whole is such that the monolithic plate is first lowered by a driving means with the wired terminal being clamped by the holding hands, and the wired terminal is put behind the connector housing. Then the open-close cylinders for activating the holding hands are moved forward along the junction plate, so that the terminal is inserted into the connector housing through a gap between the guide arms. Thereafter, the monolithic plate is urged rearwardly by a horizontal cylinder as an activating means thereof, so that the wired terminal is pulled rearwardly with the wire part being clamped by the holding hand to check the inserted state thereof.

As a result of the checking, if an imperfect insertion is detected, the holding hands and guide arms are integrally retreated rearwardly. Here, since the terminal is placed in front of the guide arms, it is never interfered with the guide arms. The guide arms are situated behind the leading wires, and from this state, the monolithic plate is sent upward by the driving means, whereby the guide arms and the holding hands are also sent upward through a gap among the leading wires. Here, the guide arms are smoothly sent upward through a wide space behind the leading wires without interfering with the wires.

Other features and advantages of the invention will be apparent from the following description taken in connection with the accompanying drawing.

DETAILED DESCRIPTION OF THE PREFERRED EMBODIMENTS

Figure 1:
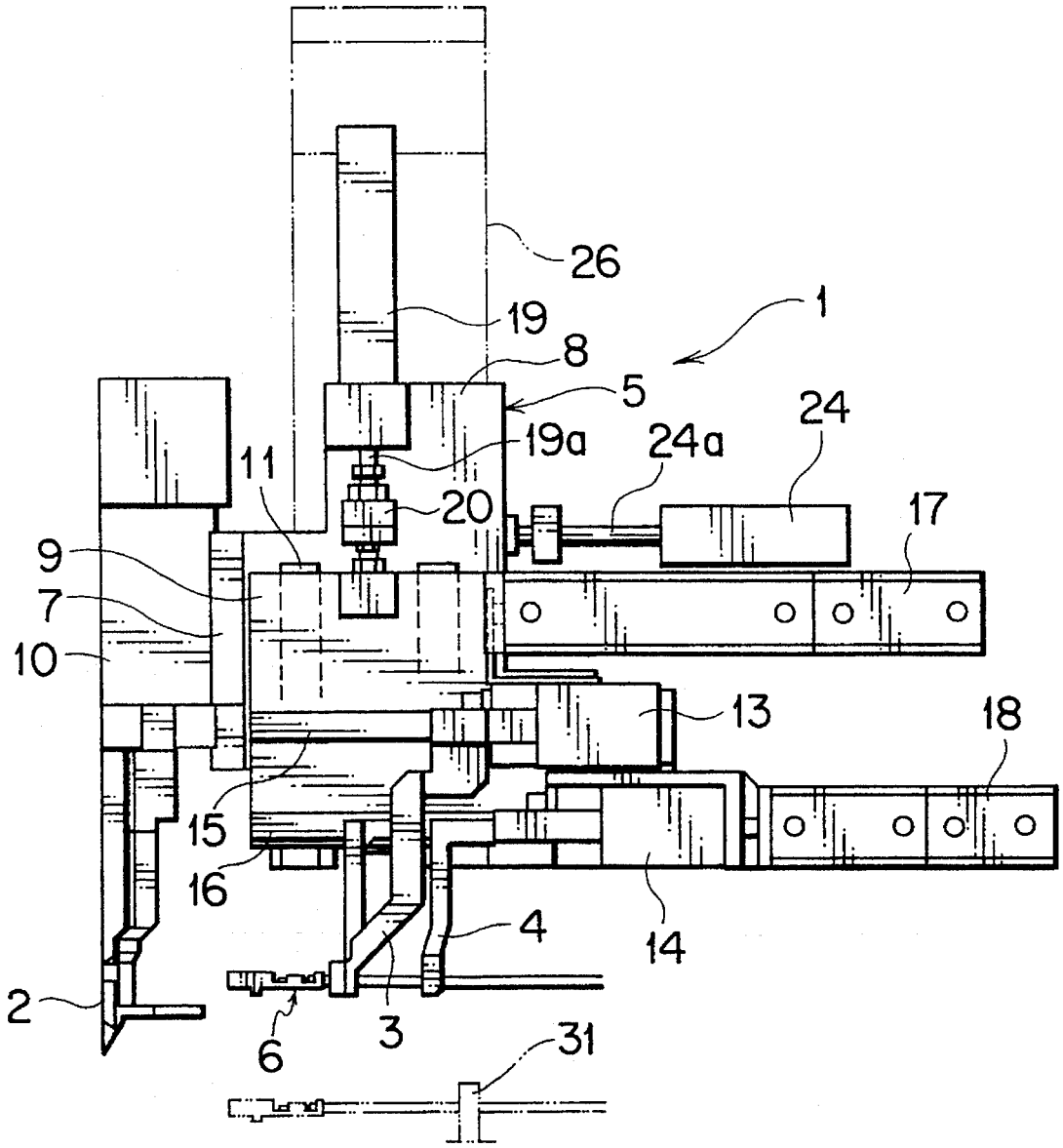
FIG. 1 is a side view of a terminal insertion device according to one embodiment of the present invention.
Figure 2:
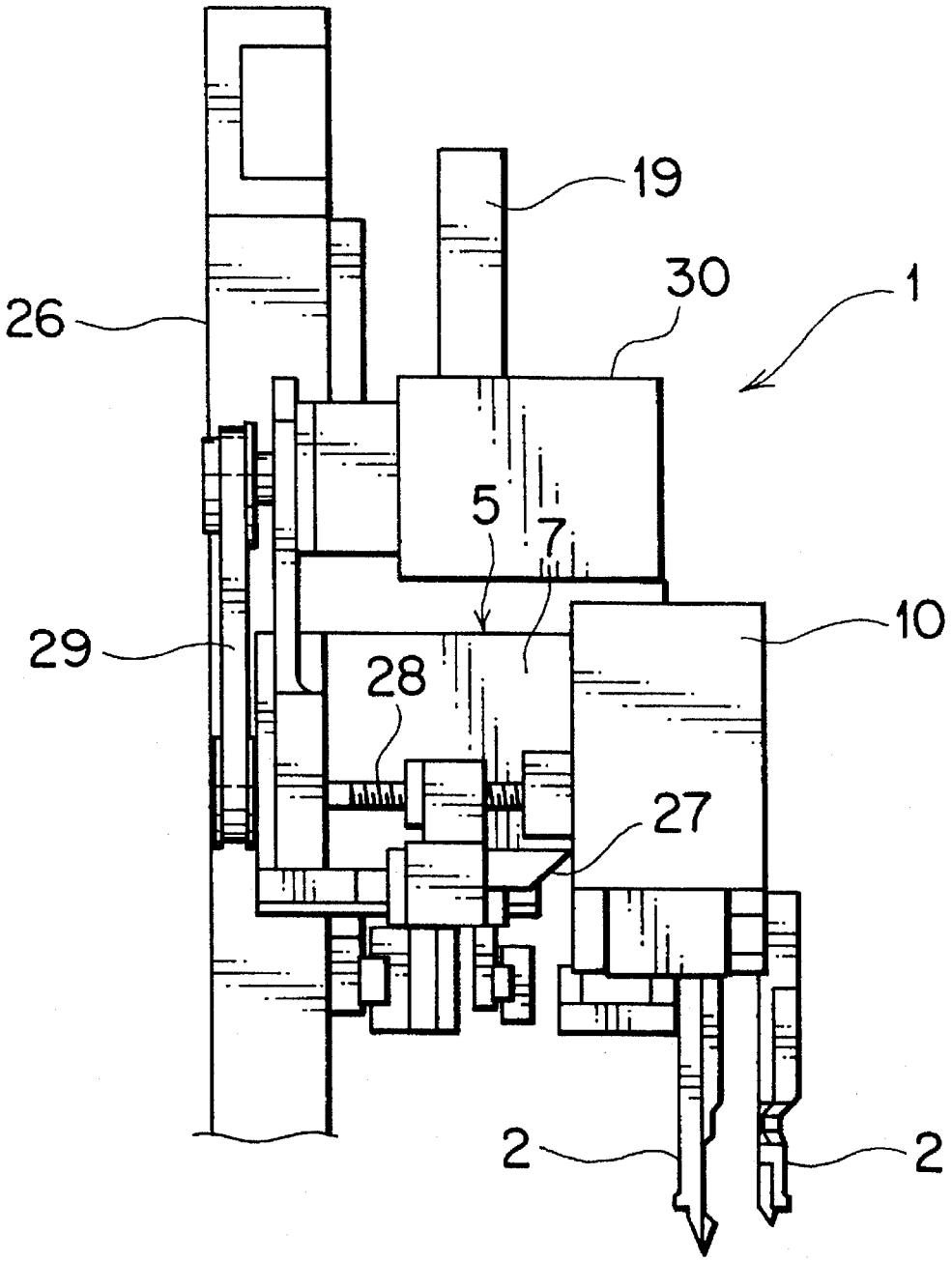
FIG. 2 is a front view of the device of FIG. 1.
Figure 3:
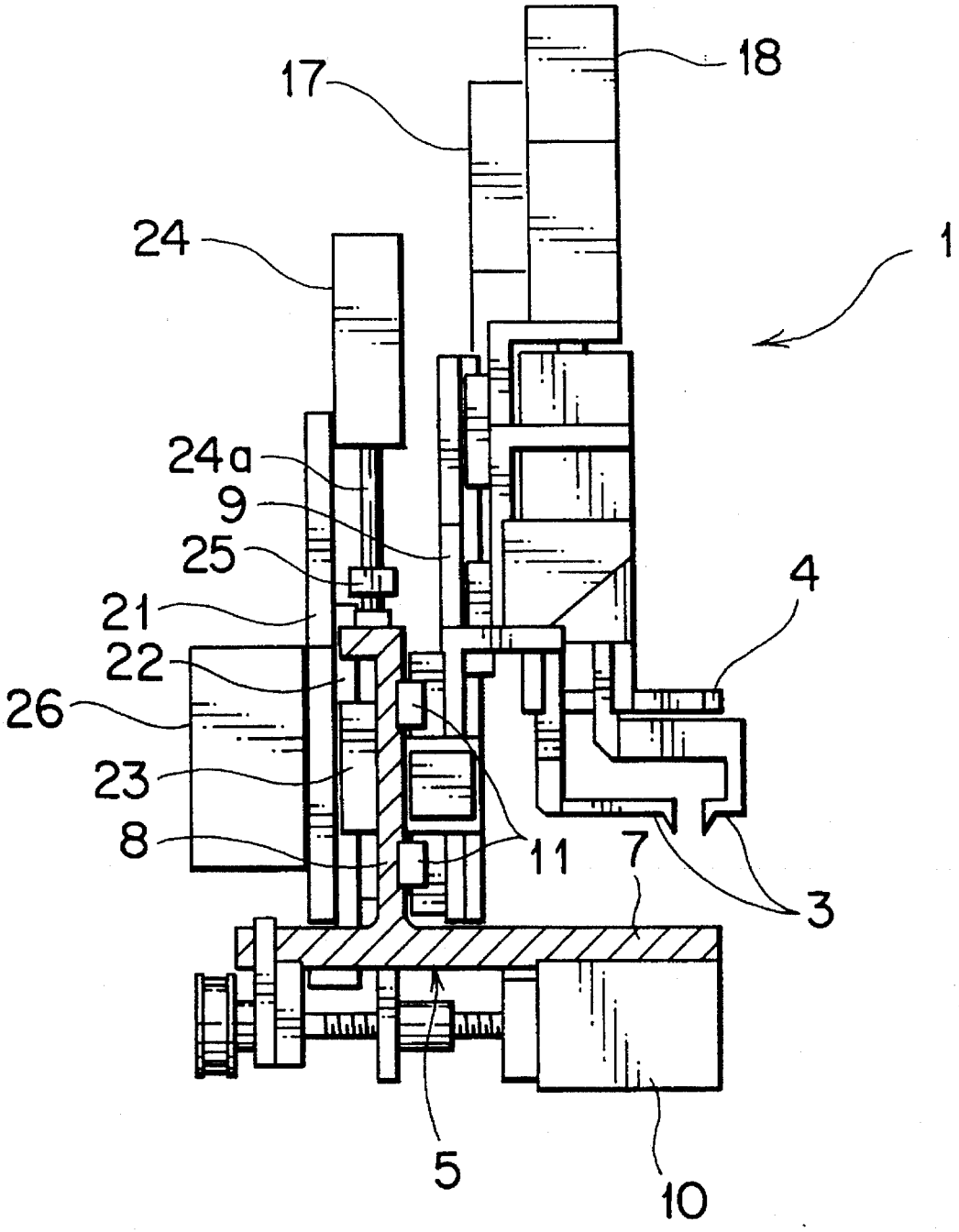
FIG. 3 is a plan view of the device of FIG. 1.

In FIGS. 1 to 3, one embodiment of a terminal insertion device of the present invention is indicated. In the figures, reference numeral 1 denotes a terminal insertion device (insertion head) wherein a pair of guide arms 2, a terminal holding hand 3 and a wire holding hand 4 are integrally mounted on a monolithic plate 5 made of a metal or the like, and is constructed such that these holding hands 3, 4 and the guide arms 2 are shiftable in the forward and rearward directions, in other words in the direction for inserting and/or removing a wired terminal 6, and in the upward and downward directions, in other word in the vertically movable direction of the guide arms 2, respectively.

The monolithic plate 5 is, as shown in FIG. 3, constructed in a substantially T shape by forming a side wall 8 on the back surface of the front wall 7, wherein the guide arms 2 are mounted on the front wall 7 and both hands 3, 4 are mounted on the side wall 8 by way of a 3unction plate 9. As shown in FIGS. 1 and 3, an open-close cylinder 10 for opening and/or closing the guide arms 2 is firmly fixed onto the front wall 7, a pair of vertical rails 11, 11 parallel in the vertical direction with each other are provided at the lower half of the side wall 8, the junction plate 9 is engaged with the vertical rails 11, 11 in a vertically movable manner, and provided on the junction plate 9 are open-close cylinders 13 and 14 for opening and/or closing the terminal holding hand 3 and a wire holding hand 4 respectively. These cylinders 13 and 14 are respectively engaged with mutually parallel horizontal rails 15 and 16 in a slidable manner.

Further, at the rear portion of the junction plate 9, a pair of horizontal cylinders 17 and 18 are fixed at vertically different levels, wherein the upper first horizontal cylinder 17 is connected with the open-close cylinder 13 for the terminal holding hand 3, the lower second horizontal cylinder 18, and with the wire holding hand 4, whereas the second horizontal cylinder 18 is further connected with the open-close cylinder 14 for the wire holding hand 4. These first and second horizontal cylinders 17 and 18 can be movable in the two; a first and a second stroke modes, respectively.

Still further, fixedly mounted on the upper surface of the side wall 8 of the monolithic plate 5 is a vertical cylinder 19 whose rod **19*a* is connected with the 3unction plate 9 through a float joint 20. As shown in FIG. 3, a frame board 21 is provided outside the side wall 8 in a parallel relation therewith, and the slide guide 23 of the side wall 8 is engaged with the horizontal rail 22 mounted on the frame board 21. Fixed to the rear portion of the frame board 21 is a third horizontal cylinder 24 as a driving member for the monolithic plate 5, and a rod 24*a* of this cylinder 24 is connected with the rear end portion of the side wall 8 by way of a float joint 25. The frame board 21 is fixed to a ball screw unit 26 in the upward direction of the plate main body (not shown), and is movable in the vertical direction integrally with the monolithic plate 5. The ball Screw unit 26 functions as a driving means of the monolithic plate 5, and the monolithic plate 5 is movable in the forward and rearward directions by the third horizontal cylinder 24**.

On the front wall 7 of the monolithic plate 5, as shown in FIGS. 2 and 3, a stopper 27 for adjusting an opening and/or closing width of the open-close cylinder 10 for the guide arms 2 and a screw shaft 28 for activating the stopper 27 are disposed, while on the upper side of the front side 7, a motor 30 is disposed for activating the screw shaft 28 by way of a belt 29.

Figure 4:
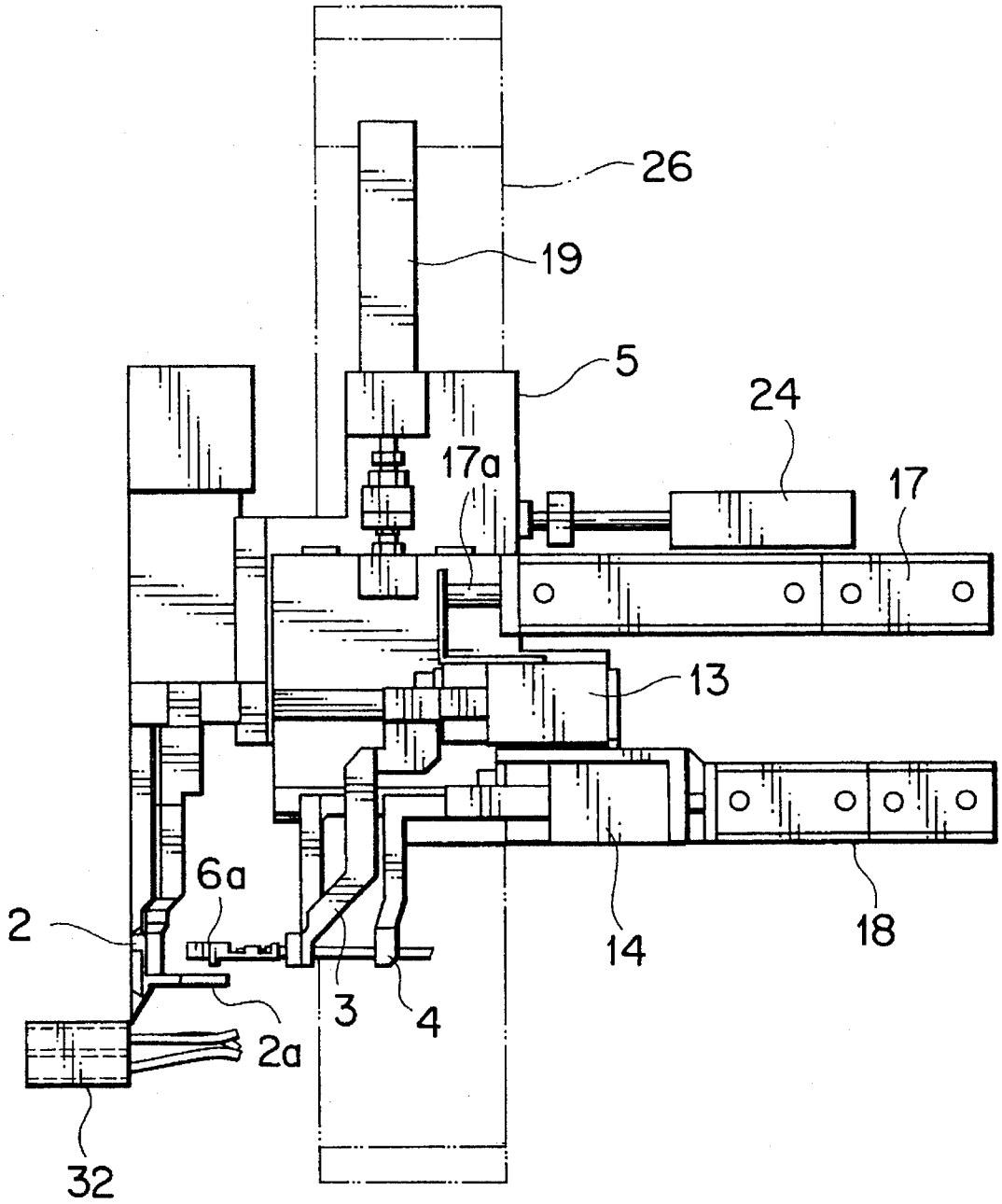
FIG. 4 is side view showing a state that a wired terminal is put adjacent to guide arms.

FIGS. 4 to 7 indicate a state in which the above terminal insertion device (insertion head) 1 is actually operating. The junction plate 9 is lowered from the state of FIG. 1 by a shrinking or extending movement of the rod **19*a* of the vertical cylinder 19, and the holding hands 3 and 4 that have picked up the wired terminal 6 from a clamp 31 move forward together with the open-close cylinders 13 and 14 by a first stroke of the rod 17*a* of the first horizontal cylinder 17 as shown in FIG. 4, to put the terminal 6*a* above the protruded plate 2*a* of the guide arms 2**.

Figure 5:
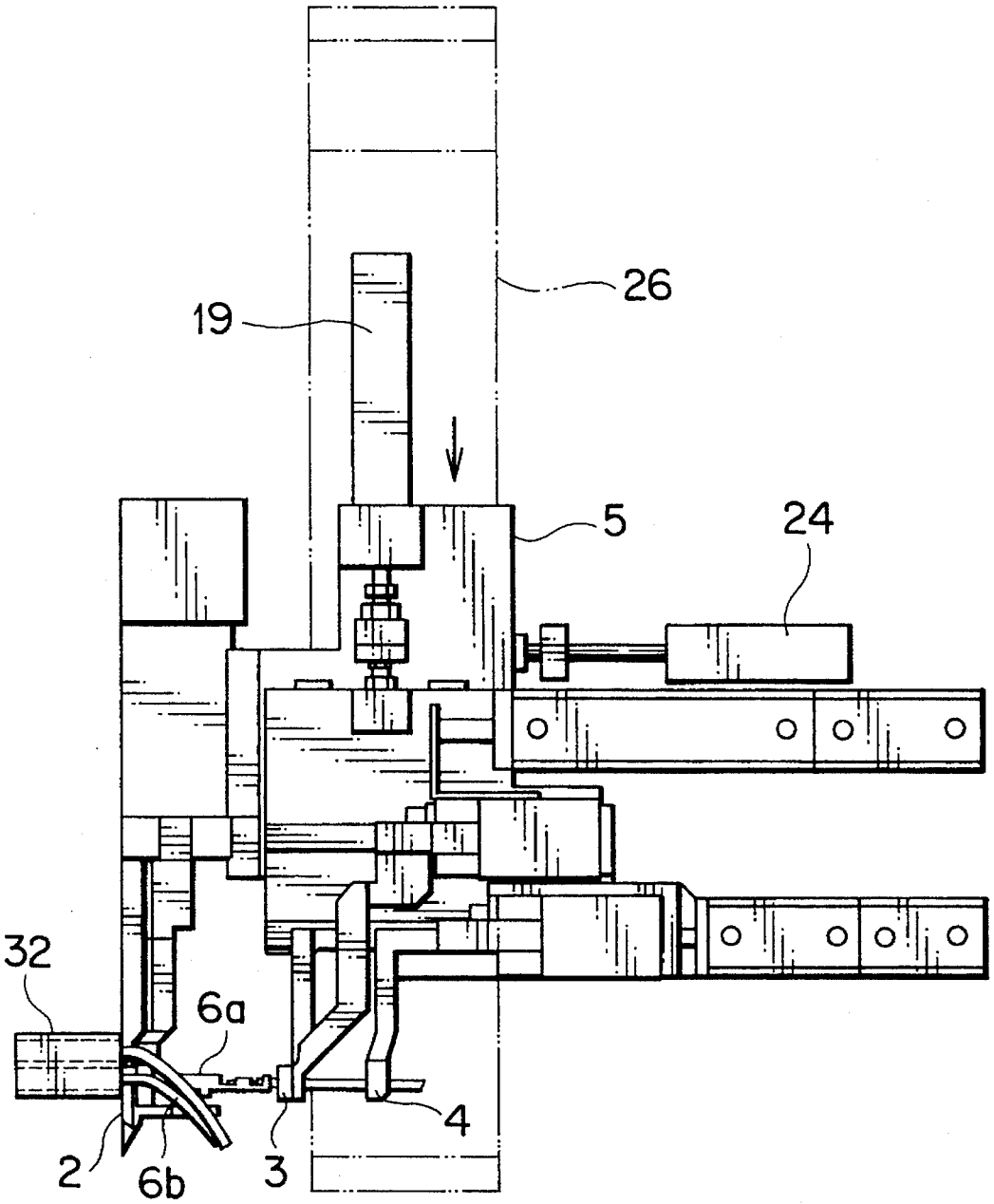
FIG. 5 is a side view showing a state that the guide arms are inserted into a space among the leading wires.
Figure 6:
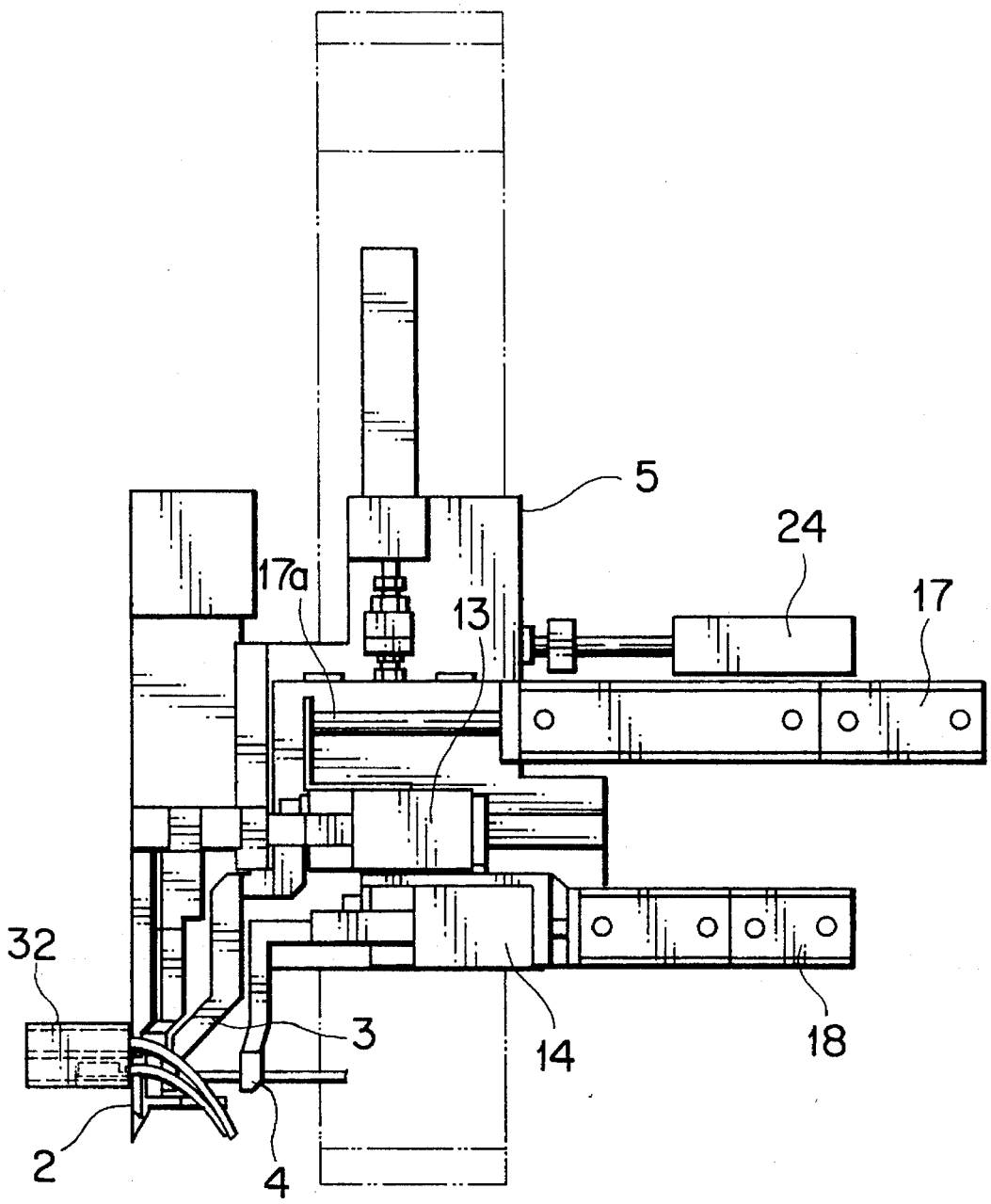
FIG. 6 is a side view showing a state that the terminal is preliminarily inserted.
Figure 7:
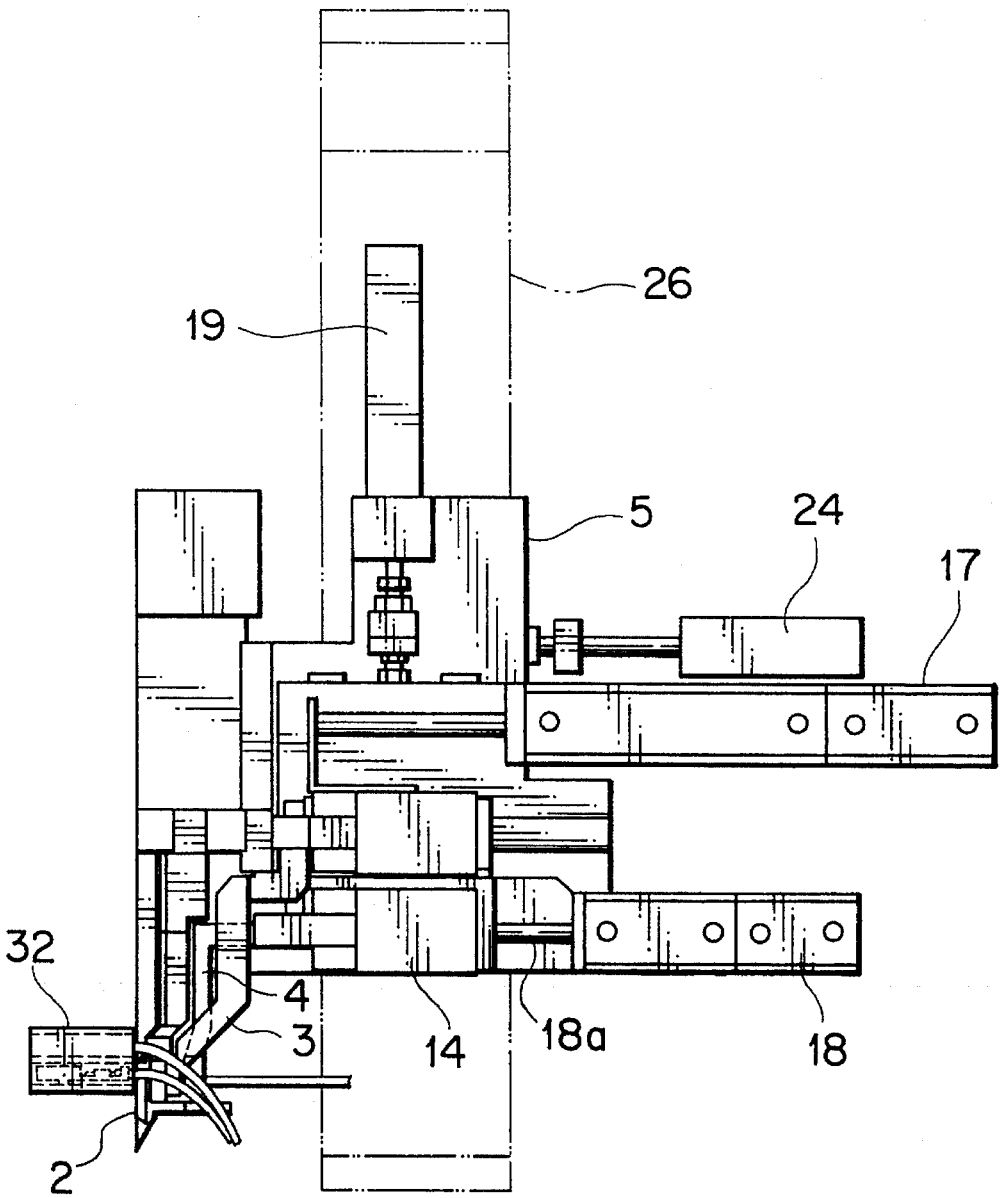
FIG. 7 is a side view showing a state that the terminal is secondarily inserted.
Figure 12:
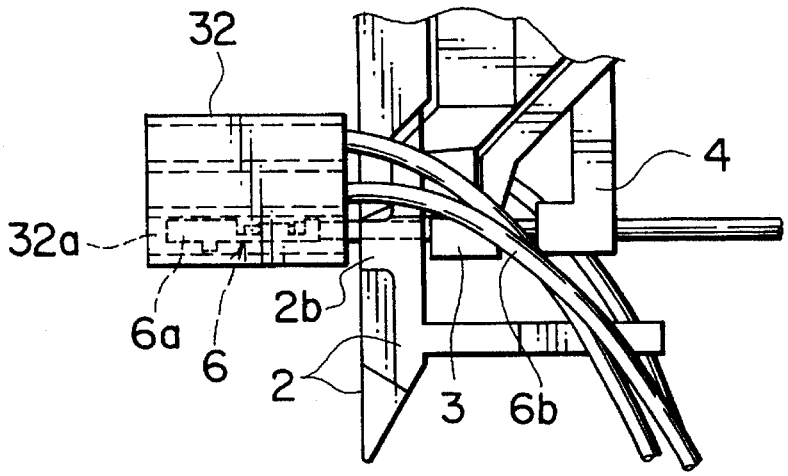
FIG. 12 PRIOR ART
FIG. 12 is a side view of the important part of a conventional device showing a state that the terminal is being checked whether it is completely inserted and that the guide arms are going to be sent upward.
Figure 13:
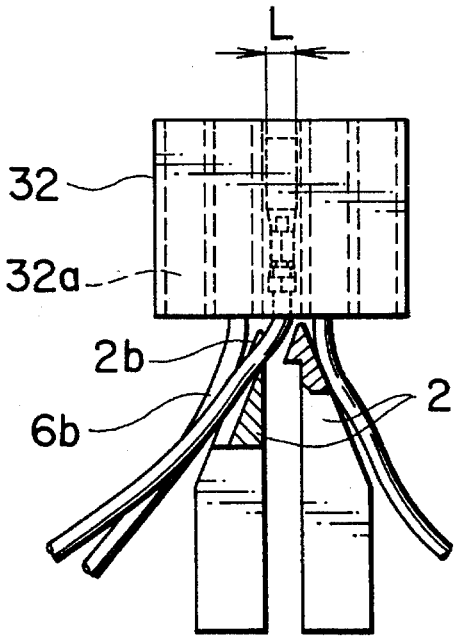
FIG. 13 PRIOR ART
FIG. 13 is a plan view of FIG. 12.

Then, as shown in FIG. 5, the monolithic plate 5 is lowered by an operation of the ball screw unit 26 in the vertical direction, and the guide arms 2 and both holding hands 3 and 4 are lowered together with the monolithic plate 5. The pair of guide arms 2 intrude among a plurality of leading wires **6*b* extended from the connector housing 32 (same state as that of the conventional device shown in FIG. 12), and are opened slightly wider than the width of the terminal itself to push the leading wires 6*b* aside. Here, the terminal 6*a* is protected by the horizontally protruded plate 2*a* from being interfered with the leading wires Thereafter, as shown in FIG. 6, the open-close cylinders 13 and 14 both move forward simultaneously by a second stroke of the rod 17*a* of the first horizontal cylinder 17 to persuade the holding hands 3 and 4 to insert the terminal 6*a* to the connector housing 32 as a provisional insertion, and thereafter with the terminal holding hand 3 opened, only the cylinder 14 for the wire holding hand 4 moves forward by a second stroke of the rod 18***a* of the second horizontal cylinder 18 as shown in FIG. 7, so as to persuade the wire holding hand 4 to further insert the terminal 6*a* into the housing as a secondary insertion.

Figure 8:
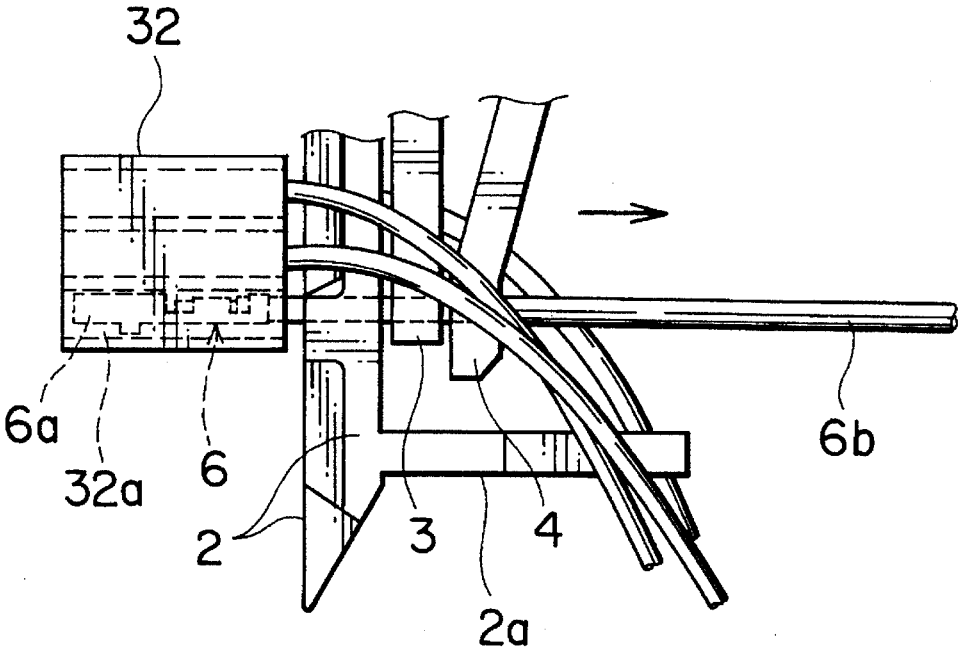
FIG. 8 is a side view of the important part of the device showing a state that the terminal is being checked whether it is perfectly inserted.

In this state, the terminal 6*a* is fully inserted into the terminal accommodating chamber 32*a* of the connector housing 32 as shown in FIG. 8. Then, as shown in FIG. 7, by pulling the monolithic plate 5 back with the third horizontal cylinder 24, the wire holding hand 4, the terminal holding hand 3 and the guide arms 2 are all urged rearward integrally, with the wire holding hand 4 clamping the wire 6*b* of the wired terminal 6, to thereby pull the wire 6*b* and check whether the terminal 6*a* is completely and securely locked.

Figure 9:
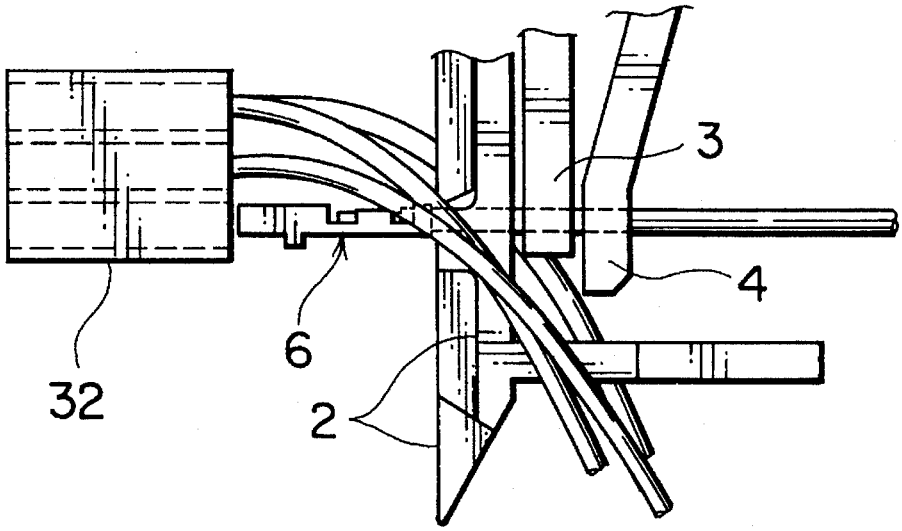
FIG. 9 is a side view of the important part of the device showing a state that the rear portion of the terminal has come off.

If, on this occasion, the insertion of the terminal is detected to be incomplete, the guide arms 2 and the holding hands 3 and 4 are simultaneously pulled back in accordance with the backward movement of the monolithic plate 5 as shown in FIG. 9, the wired terminal 6 is securely pulled back from the connector housing 32. In other words, since the guide arms 2 are not situated in the close proximity of the connector housing 32, even if the terminal 6*a* is pulled back, it is not interfered with the guide arms 2, and thus the terminal 6*a* is securely and safely pulled out of the connector housing 32.

Figure 10:
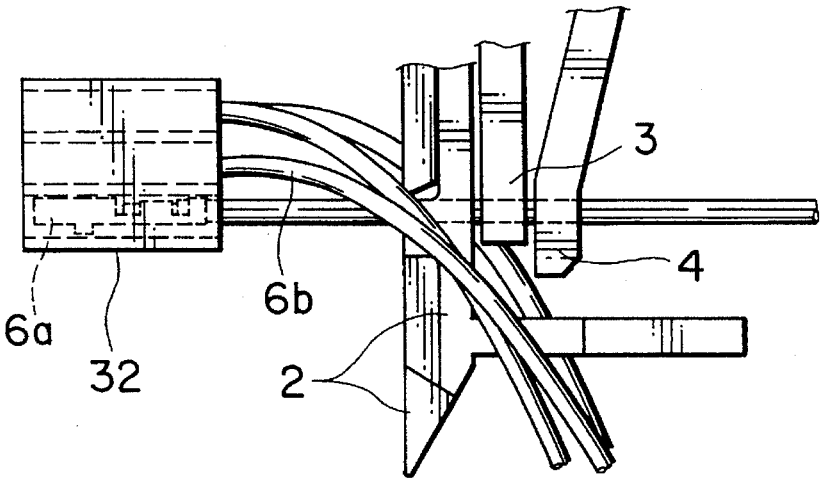
FIG. 10 is a side view of the important part of the device showing a state that the guide arms and holding hands are pulled backwardly.
Figure 11:
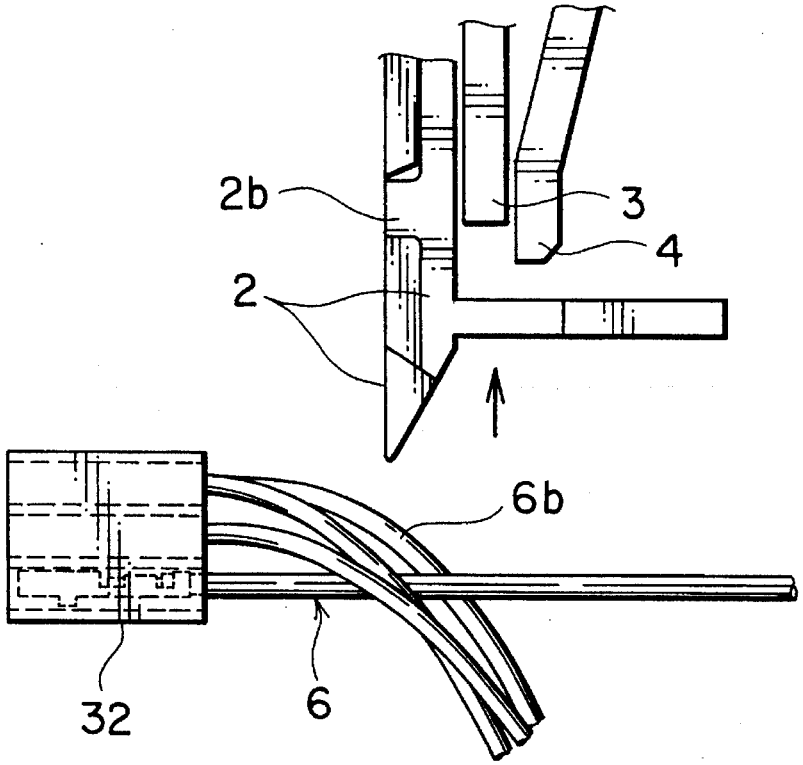
FIG. 11 is a side view of the important part of the device showing a state that the guide arms and holding hands are upwardly retreated.

Then as shown in FIG. 10, by sending the monolithic plate 5 upward with the ball screw unit 26 with the wire holding hand 4 being opened to release the wire 6*b*, the guide arms 2 and the holding hands 3 and 4 all move upward as shown in FIG. 11, so that the guide arms 2 are pulled out from the leading wires 6*b*. In other words, since the guide arms 2 are shifted rearward to be located behind the leading wires 6*b* in FIG. 10, the guide arms 2 can move upward passing through a wide space among the leading wires 6*b*, so that the guide projection 2*b* of the guide arm 2 is not interfered with the leading wires 6*b*.

Further, since the backward movement of the guide arms 2 and the holding hands 3 and 4 checks the inserted state of the terminal 6*a* and also prevents the guide arms from interfering with the leading wires 6*b*, there will be no loss of time generated in a terminal insertion cycle. These effects are made by integrally retreating the guide arms 2 and the holding hands 3 and 4 in both the upward and backward directions by the monolithic plate 5.

[Effect of the Invention]

As explained heretofore, in the terminal insertion device of the present invention, since the guide arms and the holding hands for inserting a wired terminal are integrally shifted by a monolithic plate 5, even after an incomplete insertion of the terminal is detected by the insertion checking procedure, the guide arms are sent backward together with the holding hands, whereby the terminal is not interfered with the guide arms, enabling thereby a smooth and secure insertion checking operation to prevent any erroneous checking or erroneous movement of the device.

Further, since the guide arms can be sent upward from their already retreated state in the backward direction, they are never interfered with the leading wires extended from the connector housing, so that they never get damaged. Here, since the backward movement of the guide arms and the holding hands checks the inserted state of the terminal, there will be no loss of time generated in a terminal insertion cycle. Further, since the guide arms get never interfered with the leading wires when they are moved upward, there will be no problem caused even if the leading wires are put just above a terminal accommodating chamber for the terminal to be inserted, and thus any terminal can be selected and inserted at random.

While the invention has been described with reference to specific embodiments, the description is illustrative and is not to be construed as limiting the scope of the invention. Various modifications and changes may occur to those skilled in the art without departing from the spirit and scope of the invention as defined by the appended claims.

What is claimed is:

1. A terminal insertion device for inserting a wired terminal into a connector housing, said wired terminal being composed of a terminal portion and one or more than one wire portions, comprising;

a pair of guide arms, a first holding hand for clamping a part of the wire portion directly behind the terminal portion of the wired terminal, a second holding hand for clamping a further rear part of the wire portion of the wire terminal, and a monolithic plate on which said first and second holding hands and said pair of guide arms are integrally disposed, wherein said monolithic plate can be shifted in the forward and backward directions as well as in the upward and downward directions.

2. A terminal insertion device as claimed in claim 1, wherein said monolithic plate is composed of a front wall and a side wall forming substantially a T shape, wherein said front wall is further provided with a first open-close cylinder for opening and/or closing said guide arms, and said side wall is provided with;

a vertical cylinder mounted thereon, a junction plate engaged therewith at one side thereof in a vertically slidable manner, and a frame board engaged therewith at the other side in the forwardly and rearwardly movable manner, wherein said junction plate is formed with a second and a third open-close cylinders for respectively activating said first and second holding hands thereon, and is also connected with a horizontal cylinder mounted to said frame board.

3. A terminal insertion device as claimed in claim 2, wherein said second and third open-close cylinders formed on said junction plate are engageably mounted in the forwardly and rearwardly movable manner, and said horizontal cylinders mounted on said junction plate are connected with said second and third open-close cylinders.

4. A method for inserting a wired terminal into a connector housing, said method comprising the steps of;

clamping a wired terminal with a first holding hand and a second holding hand, lowering a pair of guide arms and said first and second holding hands integrally by activating a monolithic plate with a driving means, putting a pair of guide arms among a plurality of leading wires extended from the connector housing, opening the pair of guide arms with a first cylinder mounted to a front wall of said monolithic plate, inserting a terminal portion of the wired terminal into the connector housing as a preliminary insertion through a space between the opened guide arms, releasing said first holding hand, and further inserting the wired terminal by said second holding hand as a secondary insertion, checking the inserted state of the wired terminal by pulling the wire portion of the wired terminal backward with said second holding hand, characterized in that said checking operation of the inserted state is conducted by urging said second holding hand backward integrally with the guide arms to shift them to a position behind the leading wires, and shifting the guide arms and said first and second holding hands integrally to the upward direction.

5. A method for inserting a wired terminal into a connector housing as claimed in claim 4, wherein said opening operation of the pair of guide arms is conducted by a first open-close cylinder mounted to a front wall of said monolithic plate, and said releasing operation of the terminal portion of the wired terminal after the preliminary insertion and said further secondary inserting operation are conducted respectively by a second and a third open-close cylinders mounted on a junction plate which is engageably mounted with the monolithic plate.

* * * * *